US005720811A

United States Patent [19]

Eder

[11] Patent Number: 5,720,811

[45] Date of Patent: Feb. 24, 1998

[54] APPARATUS FOR THE WET-PAINT SPRAY PAINTING OF ARTICLES

[76] Inventor: Michael Eder, Bürgeraustrasse 20, A-9900 Lienz, Austria

[21] Appl. No.: 606,390

[22] Filed: Feb. 23, 1996

[30] Foreign Application Priority Data

Feb. 24, 1995 [AT] Austria ..... 343/95

[51] Int. Cl.[6] ..... B05C 15/00; B05B 15/12

[52] U.S. Cl. ..... 118/64; 118/50; 118/326

[58] Field of Search ..... 118/64, 50, 326

[56] References Cited

U.S. PATENT DOCUMENTS 4,181,093 1/1980 Tredwell ..... 118/323

FOREIGN PATENT DOCUMENTS 2813854 5/1987 Germany .
0910221 3/1990 U.S.S.R. .
094002254 2/1994 WIPO .

*Primary Examiner*—Peter Chin
*Assistant Examiner*—Steven B. Leavitt
*Attorney, Agent, or Firm*—Lorusso & Loud

[57] ABSTRACT

Apparatus for the wet-paint spray painting of articles having a device for catching the paint surplus which has an air-permeable dry filter, wherein the dry filter is arranged movably and there is provided a suction removal device which sucks the dried paint particles away from the dry filter.

24 Claims, 3 Drawing Sheets

APPARATUS FOR THE WET-PAINT SPRAY PAINTING OF ARTICLES

BACKGROUND OF THE INVENTION

The invention concerns an apparatus for the wet-paint spray painting of articles, having a device for catching the paint surplus, which has an air-permeable dry filter.

For catching the paint surplus in wet-paint spray painting (that is to say when spray painting liquid media, for example by way of spray nozzles or spray guns), it is already known for the paint surplus to be picked up by a filter surface and then washed out of the filter surface. Such a wet separation procedure however must involve the use of solvents which are not really environmentally compatible, and it is also necessary to provide drying devices in order to dry the filter material after the washing operation.

Besides such wet separation procedures which are known for example from German laid-open applications (DE-OS) Nos 36 18 642 and 43 00 400, it is also already known to use air-permeable dry filters which are discarded after they are clogged by the paint surplus. That is not only uneconomical but also prohibitive from the point of view of safeguarding the environment.

The object of the present invention is to provide an environmentally compatible apparatus which is inexpensive in operation for the wet-paint spray painting of articles.

SUMMARY OF THE INVENTION

In accordance with the invention, in an apparatus of the general kind set forth in the opening part of this specification, that is achieved in that the dry filter is arranged movably and that there is provided a suction removal device which sucks away from the dry filter the paint particles which have dried on during a given time.

The invention is based on the realization that there is no need in the wet-paint spray painting operation to wash out the paint surplus which is caught by the filter with liquid solvent in a wet separation procedure, but that on the contrary it is sufficient to suck the paint surplus away from the dry filter after a given drying section, so that the dry filter does not have to be discarded. Suction removal of matter from filters has long been known in the case of powder coating installations. In such installations a powder is applied electrostatically to the articles to be coated and the powder surplus is sucked away (see for example DE 28 13 854 C2). In contrast thereto the invention concerns a different general kind of subject matter, namely wet-paint spray painting with liquid media. In that wet-paint spray painting procedure, in contrast to mere powder, the paint surplus clings substantially mere firmly to the filter surface and it was therefore hitherto considered that either a dry filter had to be discarded or it had to be washed out in an expensive wet process. Surprisingly however the applicants' tests have shown that, even in the wet-paint spray painting of articles, the paint surplus can be sucked away from a dry filter without involving an expensive wet separation procedure.

In that respect it is particularly advantageous if the suction removal device is disposed at a location which is remote from that region in which the dry filter receives the paint surplus because then the paint particles, even in the case of a continuously moved dry filter, have sufficient time to dry completely so that they can be easily sucked away.

Further advantages and details of the invention will be described more fully with reference to the following specific description.

DESCRIPTION OF THE PREFERRED EMBODIMENTS

Figure 1:
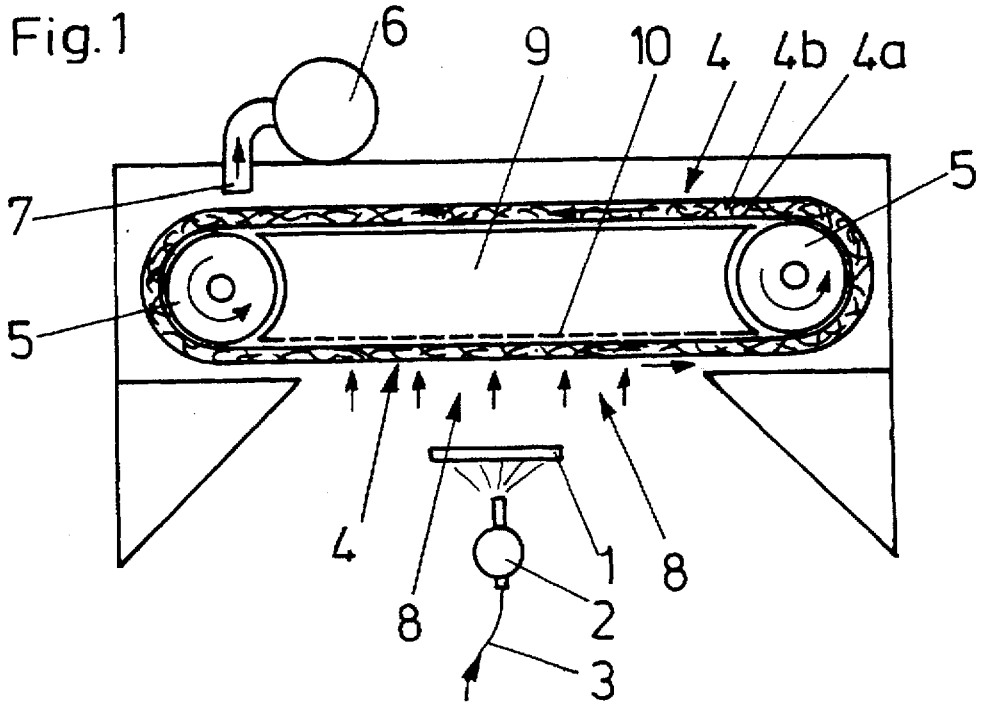
FIG. 1 is a plan view of an embodiment of an apparatus according to the invention for the hand wet-paint spray painting of articles.

FIG. 1 shows an apparatus for the wet-paint spray painting of articles 1 by means of a hand-operable spray gun 2 which for example has a container for liquid paint and which is connected to a compressed air line 3. In accordance with the invention, provided for catching the paint surplus which goes past the article 1 is an air-permeable dry filter 4 which is arranged movably over direction-changing drums 5. In addition, in accordance with the invention there is provided a suction removal device 6 whose suction intake opening 7 is disposed at a location which is as far removed as possible, in the direction of movement of the dry filter 4, from the region 8 in which the dry filter receives paint excess. Connected between the front run and the rear run of the endlessly circulating dry filter is an exhaust air passage 9 of an exhaust air installation which sucks air out of the exhaust air passage 9. The front side of the exhaust air passage 9 is of an air-permeable configuration or is perforated at the location 10 so that the exhaust air which passes through the dry filter 4 can pass into the exhaust air passage 9. When that happens the paint particles are caught by the dry filter 4 and are later removed by suction by the suction removal device 6. In that way it is possible for the dry filter 4 to be continuously cleaned. The dry filter can be continuously moved. However discontinuous movement is also possible, for example in a separate cleaning run in the evening.

The dry filter 4 is advantageously of a two-part configuration, namely comprising an air-permeable statically stable but nonetheless flexible carrier 4*a* and the actual dry filter material 4*b*. The filter material is preferably a fleece, desirably a polyester fleece or a glass fiber fleece , which is of a height of typically some centimeters. The carrier 4*a* can be provided with holes 11, as is shown by the view from below in FIG. 2*b*. Desirably the carrier comprises conveyor material, for example fiber-reinforced rubber. It is also possible for the carrier 4*a* to be formed from an air-permeable fabric (that is to say without discrete holes 11).

For the purposes of joining the carrier 4*a* to the actual filter material 4*b*, it is desirable for them to be glued together.

Figure 2A:
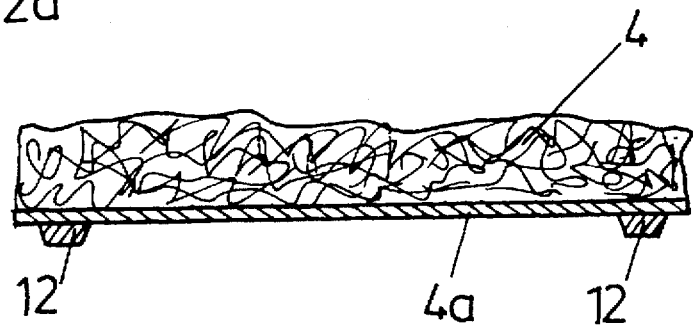
FIG. 2*a* is a view in cross-section of an embodiment of a dry filter according to the invention.
Figure 2B:
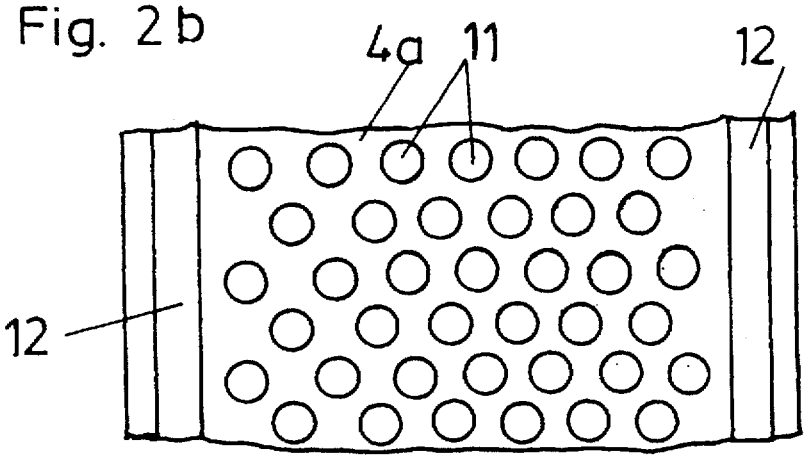
FIG. 2*b* shows an underview of the FIG. 2*a* dry filter.

In order to permit a guidance effect for the circulating dry filter 4, two guide projections 12 are provided at the rear side of the dry filter 4 in the embodiment shown in FIGS. 2*a* and 2*b*. Those guide projections 12 can then be guided in suitable guide grooves (not shown) in the direction-changing rollers 5 and then guide the circulating dry filter 4 in the transverse direction.

Figure 3:
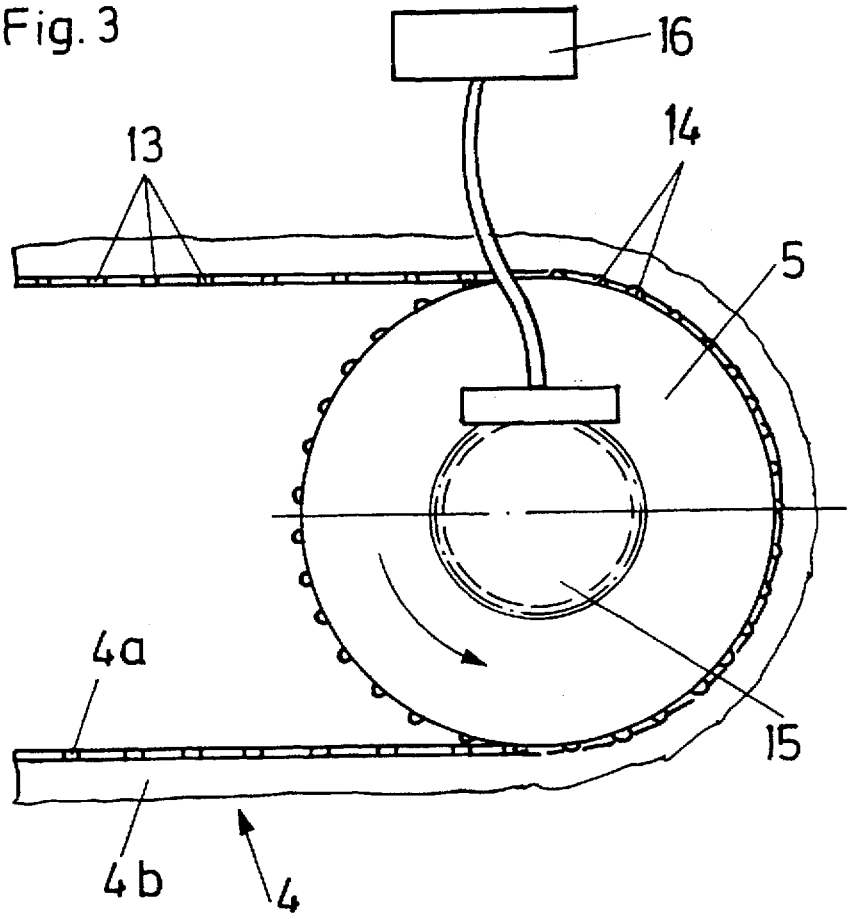
FIG. 3 shows a direction-changing drum for the movable dry filter according to the invention.

In the embodiment shown in FIG. 3, for the purposes of guiding the circulating dry filter 4 and to provide for exact drive thereof, it is provided that the carrier 4*a* has at least one row of holes 13 into which engage pins 14 arranged on the guide roller 5 which is in the form of a drive wheel. The drive wheel 5 is driven by an electric motor 15 disposed thereabove, possibly by way of a transmission (not shown). The electric motor 15 is controlled by a control device 16.

Figure 4:
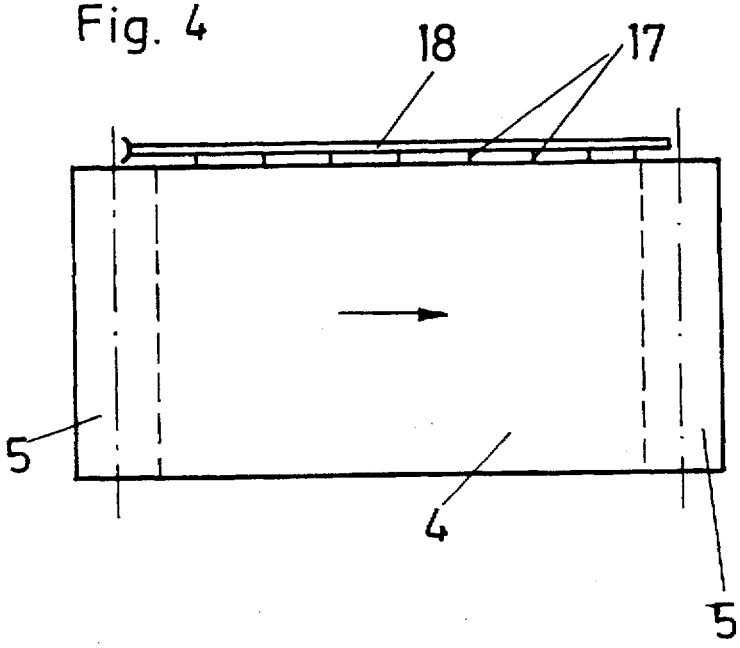
FIG. 4 is a front view of a further embodiment of a device according to the invention for catching the paint surplus.

In the embodiment shown in FIG. 4 the dry filter 4 also circulates in the horizontal direction. Guidance in the vertical direction is effected by virtue of the fact that at the top the dry filter 4 has guide elements 17 which are guided in a stationary horizontal guide rail 18 (similarly to a curtain rail). The guide rail 18 can be endlessly taken around the entire periphery above the dry filter. It is however also possible for the guide rail 18 to be disposed only in the front region and the rear region and for the vertical guidance effect in the region of the direction-changing rollers 5 to be afforded by other means, for example by the pins 14 which engage into the rows of holes 13.

Figure 5:
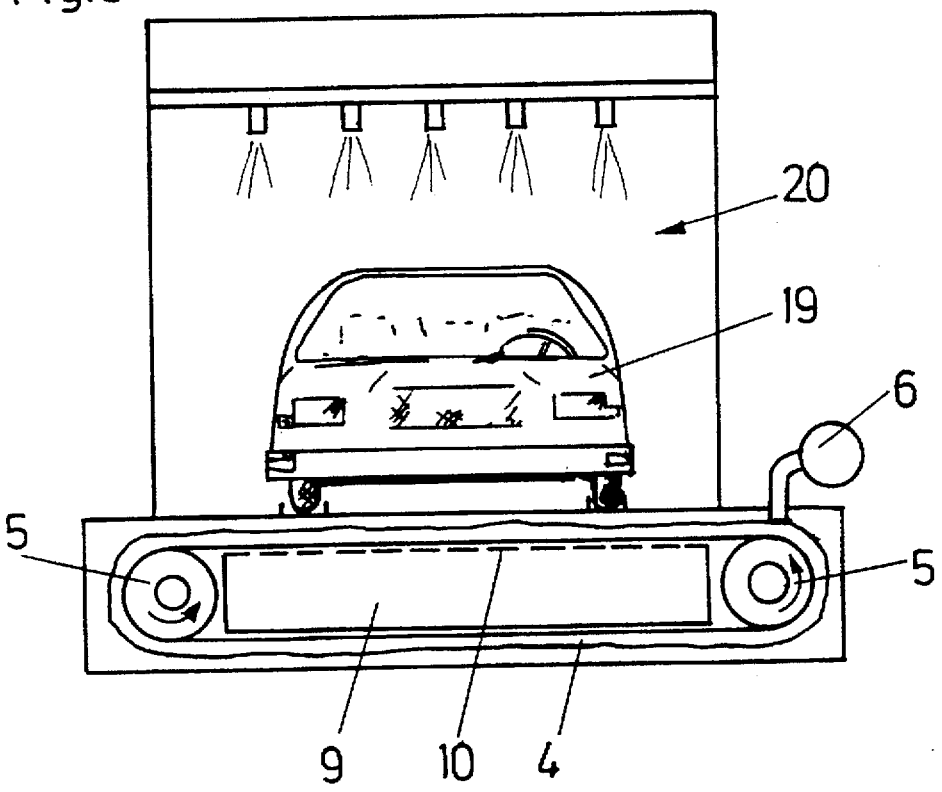
FIG. 5 shows an embodiment for spray painting of a motor vehicle.

FIG. 5 shows an apparatus for the spray painting of a motor vehicle 19. Here the dry filter 4 is oriented horizontally and runs beneath the spray cabin 20.

Figure 6:
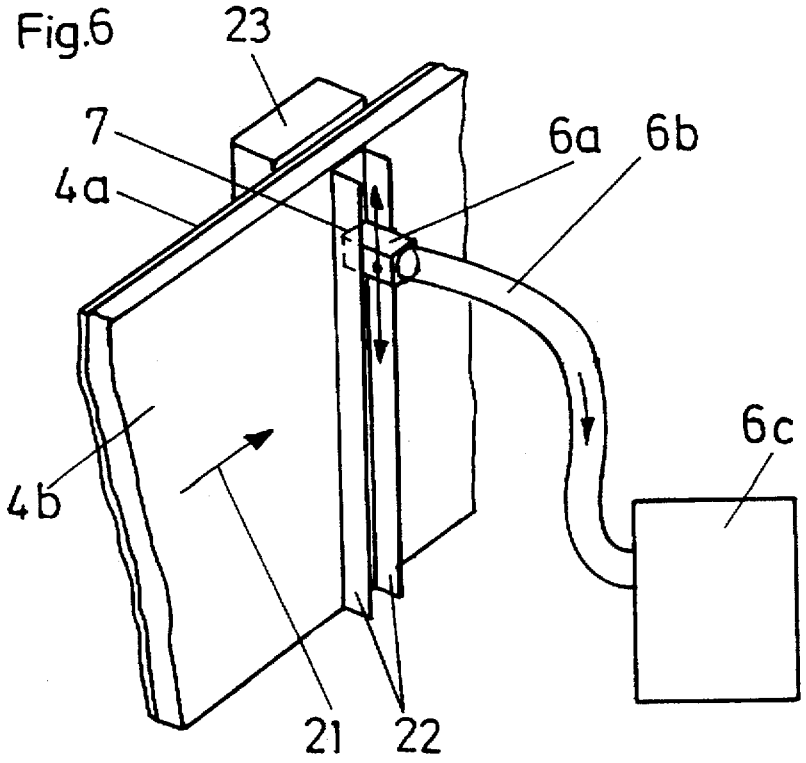
FIG. 6 is a diagrammatic perspective view of an embodiment of a suction removal device with a suction nozzle which is movable transversely to the dry filter.

In the embodiment shown in FIG. 6 the suction intake opening 7 of the suction removal device is moved transversely to the direction of movement 21 of the dry filter 4. This has the advantage that it is possible to use a shall suction nozzle 6*a* with a high local suction capability in order to suck the dried paint particles away from the dry filter 4. The suction nozzle 6*a* is connected by way of a flexible hose 6*b* to the suction unit 6*c* of the suction removal device. The arrangement has two fixed guide rails 22 which guide the suction nozzle 6*a*. The movement of the suction nozzle 6*a* in the vertical direction in FIG. 6 is preferably effected by way of a motor drive (not shown), for example by way of a cable pull drive, a spindle drive, a toothed rack drive or the like.

In general the extraction effect will be achieved just with the suction removal action. In cases of a special nature however it is also possible to arrange at the rear side (side of the carrier 4*a*) of the conveyor belt 4 a device 23 for mechanically knocking against the dry filter 4 in order to be able better to detach the paint particles therefrom. The device 23 can also serve to produce an air flow which is directed from the rear side of the dry filter 4 to the front side and which thus promotes the suction removal air movement.

I claim:

1. Apparatus for the wet-paint spray painting of articles, having a device for catching the paint surplus, which has an air-permeable dry filter, an exhaust air passage connected to an exhaust air installation being arranged behind a rear side of the dry filter, which is remote from the article to be painted so that air loaded with paint surplus is directed from a painting area to the dry filter, characterized in that the dry filter is arranged movably and that there is provided a suction removal device which is separate from said exhaust air installation and sucks away directly from the dry filter the paint particles which have dried during a given time.

2. Apparatus according to claim 1, characterized in that the dry filter is drivable by way of an electrical motor.

3. Apparatus according to claim 1, characterized in that the dry filter is in the form of an endlessly circulating filter surface which is guided over direction-changing rollers.

4. Apparatus according to claim 1, characterized in that the dry filter is moved when the exhaust air installation is switched on.

5. Apparatus according to claim 1, characterized in that the dry filter comprises an air-permeable flexible carrier and a filter material secured thereto.

6. Apparatus according to claim 5, characterized in that the filter material is a fleece.

7. Apparatus according to claim 6, characterized in that said fleece is made of polyester or glass fibers.

8. Apparatus according to claim 5, characterized in that the carrier is perforated.

9. Apparatus according to claim 8, characterized in that said carrier comprises conveyor belt material.

10. Apparatus according to claim 5, characterized in that the carrier comprises air-permeable fabric.

11. Apparatus according to claim 5, characterized in that the carrier and the filter material are glued together.

12. Apparatus according to claim 1, characterized in that on its rear side the dry filter has at least one guide projection.

13. Apparatus according to claim 1, characterized in that the dry filter has at least one row of holes into which a drive wheel engages with pins.

14. Apparatus according to claim 1, characterized in that the vertically oriented dry filter is moved horizontally.

15. Apparatus according to claim 1, characterized in that at the top the dry filter has guide elements which are movably guided in a stationary horizontal guide rail.

16. Apparatus according to claim 1, characterized in that the suction removal device is arranged at a location which is remote from that region in which the dry filter receives paint surplus.

17. Apparatus according to claim 16, characterized in that the suction removal device is arranged at a spacing, as measured in the direction of movement of the dry filter, of at least 50% of the total peripheral length as measured in the direction of movement of the dry filter, from that region in which the dry filter receives paint surplus.

18. Apparatus according to claim 17, characterized in that the spacing is at least 70% of the total length of the dry filter.

19. Apparatus according to claim 1, characterized by a device for mechanically knocking against the dry filter.

20. Apparatus according to claim 19, characterized in that the device knocks against the rear side of the dry filter.

21. Apparatus according to claim 1, characterized by a blowing device for producing an air flow which is directed through the dry filter from the rear side thereof to the front side thereof.

22. Apparatus for the wet-paint spray painting of articles, having a device for catching the paint surplus, which has an air-permeable dry filter, an exhaust air passage connected to an exhaust air installation being arranged behind a rear side of dry filter, which is remote from the article to be painted so that air loaded with paint surplus is directed from a painting area to the dry filter, characterized in that the dry filter is arranged movably and that there is provided a suction removal device which is separate from said exhaust air installation and sucks away directly from the dry filter the paint particles which have dried during a given time, and in that at least one suction intake opening of the suction removal device is movable over the dry filter transversely to the direction of movement thereof.

23. Apparatus according to claim 22, characterized in that the suction intake opening is provided on a suction nozzle which is guided movably on a fixed guide means and which is moved by motor means.

24. Apparatus according to claim 23, characterized in that the suction nozzle is connected by way of a flexible hose to the suction unit of the suction removal device.

* * * * *